US006852423B2

(12) United States Patent
Schädler et al.

(10) Patent No.: US 6,852,423 B2
(45) Date of Patent: Feb. 8, 2005

(54) PAPER COATING SLIPS CONTAINING BINDING AGENTS WITH MACROMONOMERS

(75) Inventors: Volker Schädler, Mannheim (DE); David Christie, Mannheim (DE); Roland Ettl, Hassloch (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/240,267

(22) PCT Filed: Mar. 27, 2001

(86) PCT No.: PCT/EP01/03469

§ 371 (c)(1),
(2), (4) Date: Sep. 30, 2002

(87) PCT Pub. No.: WO01/73199

PCT Pub. Date: Oct. 4, 2001

(65) Prior Publication Data

US 2003/0068478 A1 Apr. 10, 2003

(30) Foreign Application Priority Data

Mar. 28, 2000 (DE) ..... 100 15 262

(51) Int. Cl.[7] ..... D21H 19/56

(52) U.S. Cl. ..... 428/514; 427/294; 427/295; 428/512; 428/513; 524/460; 526/201

(58) Field of Search ..... 427/394, 395; 428/512, 513, 514; 524/460; 526/201

(56) References Cited

U.S. PATENT DOCUMENTS

| | | | |
|---|---|---|---|
| 4,448,924 A | 5/1984 | Reeb et al. | 524/460 |
| 5,872,189 A | 2/1999 | Bett et al. | 525/243 |

FOREIGN PATENT DOCUMENTS

| | | |
|---|---|---|
| EP | 0 058 366 | 8/1982 |
| EP | 0 320 594 | 6/1989 |
| EP | 0 714 922 | 6/1996 |
| WO | 95 04767 | 2/1995 |
| WO | 97 00776 | 1/1997 |

*Primary Examiner*—D. S. Nakarani
(74) *Attorney, Agent, or Firm*—Oblon, Spivak, McClelland, Maier & Neustadt, P.C.

(57) ABSTRACT

In paper coating slips containing, as a binder, a copolymer which is obtainable by free radical polymerization of ethylenically unsaturated compounds, at least one of the ethylenically unsaturated compounds is a polymer having at least one copolymerizable ethylenically unsaturated group, a number average molecular weight of from 500 to 50000 g/mol and at least one carboxyl group (referred to below as ethylenically unsaturated polymer for short).

13 Claims, No Drawings

PAPER COATING SLIPS CONTAINING BINDING AGENTS WITH MACROMONOMERS

BACKGROUND OF THE INVENTION

1. Field of the Invention

The present invention relates to paper coating slips containing, as a binder, a copolymer which is obtainable by free radical polymerization of ethylenically unsaturated compounds, wherein at least one of the ethylenically unsaturated compounds is a polymer having at least one copolymerizable ethylenically unsaturated group, a number average molecular weight of from 500 to 50000 g/mol and at least one carboxyl group (referred to below as ethylenically unsaturated polymer for short).

Paper coating slips essentially comprise pigment and binder. The binder is intended to fix the pigments to the paper and to ensure cohesion in the coating obtained.

In the printing process, for example in an offset printing press, strong tensile forces act on the coated paper (paper coat) owing to the high viscosity of the printing ink. The resistance which the paper coat offers to these forces is referred to as pick resistance. A distinction is made between dry pick resistance and wet pick resistance. The wet pick resistance is important particularly in aqueous offset printing since, in the second printing unit, the printing ink comes into contact with a water-moist paper, and the paper coat must have sufficient binding power under these conditions.

2. Description of the Background

In order to increase the pick resistance, the polymers generally contain acid groups. Such polymers are described, for example, in WO 97/00776.

Emulsion polymers which have ethylenically unsaturated polymers having a plurality of acid groups as components form the subject of WO 95/04767.

In the case of paper coating slips known to date, the binding power of the binder and hence the pick resistance are still insufficient.

SUMMARY OF THE INVENTION

It is an object of the present invention to provide paper coating slips having improved pick resistance.

We have found that this object is achieved by the paper coating slips defined at the outset.

DETAILED DESCRIPTION OF THE PREFERRED EMBODIMENTS

The novel paper coating slip contains, as a binder, the copolymer defined at the outset.

The copolymer is obtainable by free radical polymerization, preferably by emulsion polymerization, of copolymerizable, ethylenically unsaturated compounds.

At least one of the ethylenically unsaturated compounds is a polymer having at least one copolymerizable, ethylenically unsaturated group, a number average molecular weight of from 500 to 50000 g/mol and at least one carboxyl group (referred to below as ethylenically unsaturated polymer for short). The content of ethylenically unsaturated groups and carboxyl groups is based on the content of the polymer chain. Preferably, the ethylenically unsaturated polymer contains one or two ethylenically unsaturated groups, particularly preferably one ethylenically unsaturated group. The or one (if a plurality are present) ethylenically unsaturated group is particularly preferably present as a terminal group in the respective polymer chain. In particular, the ethylenically unsaturated group is an acryloyl or methacryloyl group, preferably a methacryloyl group.

The ethylenically unsaturated polymer preferably contains more than 2, particularly preferably more than 4, very particularly preferably more than 8, carboxyl groups.

The ethylenically unsaturated polymer is preferably synthesized from compounds capable of free radical polymerization and is accordingly obtainable by free radical polymerization of these compounds.

Preferably, the ethylenically unsaturated polymer comprises at least 50, preferably 80, % by weight of $C_1$–$C_{10}$-alkyl(meth)acrylates, (meth)acrylic acid or mixtures thereof.

Very particularly preferably, the ethylenically unsaturated polymer comprises at least 50, in particular at least 80, % by weight of acrylic acid or methacrylic acid. Methacrylic acid is preferred.

The average molecular weight Mn of the ethylenically unsaturated polymer is preferably from 800 to 20,000, particularly preferably from 1,000 to 10,000, g/mol.

Mn is determined by gel permeation chromatography (polyacrylic acid standard and water as eluent).

The ethylenically unsaturated polymer is preferably prepared by free radical polymerization in the presence of a transition metal complex as a molecular weight regulator, for example of a cobalt chelate complex. This process is known as catalytic chain transfer polymerization (CCT) and is described, for example, in WO 95/04767 and the documents cited in this publication.

Preferably, the copolymer comprises at least 0.1, particularly preferably at least 0.3, very particularly preferably at least 1, in particular at least 2, % by weight of the ethylenically unsaturated polymer. A content of 30, in particular 20, particularly preferably 15, % by weight is in general not exceeded.

The copolymer as a whole is preferably composed of a) from 30 to 99.9% by weight of main monomers selected from $C_1$–$C_{20}$-alkyl(meth)acrylates, vinyl esters of carboxylic acids of up to 20 carbon atoms, vinylaromatics of up to 20 carbon atoms, ethylenically unsaturated nitrites, vinyl halides, vinyl ethers or allyl ethers of alcohols of 1 to 10 carbon atoms, aliphatic hydrocarbons having 2 to 8 carbon atoms and 1 or 2 double bonds or mixtures of these monomers b) from 0.1 to 30% by weight of the ethylenically unsaturated polymer c) from 0 to 40% by weight of other ethylenically unsaturated compounds.

The copolymer as a whole is preferably composed of a) from 50 to 99.5% by weight of main monomers b) from 0.5 to 20% by weight of ethylenically unsaturated polymer and c) from 0 to 30% by weight of further monomers.

Very particularly preferably the copolymer is composed of a) from 60 to 99% by weight of main monomers b) from 1 to 20% by weight of ethylenically unsaturated polymer c) from 0 to 20% by weight of further monomers.

Examples of main monomers are alkyl (meth)acrylate having a $C_1$–$C_{10}$-alkyl radical, such as methyl methacrylate, methyl acrylate, n-butyl acrylate, ethyl acrylate and 2-ethylhexyl acrylate.

Mixtures of the alkyl(meth)acrylates are also particularly suitable.

Vinyl esters of carboxylic acids of 1 to 20 carbon atoms are, for example, vinyl laurate, vinyl stearate, vinyl propionate, vinyl versatate and vinyl acetate.

Suitable vinylaromatic compounds are vinyltoluene, α- and p-methylstyrene, α-butylstyrene, 4-n-butylstyrene, 4-n-decylstyrene and preferably styrene. Examples of nitriles are acrylonitrile and methacrylonitrile.

The vinyl halides are ethylenically unsaturated compounds substituted by chlorine, fluorine or bromine, preferably vinyl chloride and vinylidene chloride.

Examples of vinyl ethers are vinyl methyl ether or vinyl isobutyl ether vinyl ethers of alcohols of 1 to 4 carbon atoms are preferred.

Examples of hydrocarbons having 2 to 8 carbon atoms and one or two olefinic double bonds are butadiene, isoprene and chloroprene, ethylene and propylene.

Preferred main monomers are $C_1$–$C_{10}$-alkyl acrylates and methacrylates, in particular $C_1$–$C_8$-alkyl acrylates and methacrylates, the acrylates being particularly preferred in each case.

Methyl acrylate, methyl methacrylate, ethyl acrylate, n-butyl acrylate, n-hexyl acrylate, octyl acrylate and 2-ethylhexyl acrylate and mixtures of these monomers are very particularly preferred.

Preferably, the copolymer is an acrylate-based copolymer, i.e. the copolymer comprises at least 60% by weight of $C_1$–$C_{20}$-alkyl(meth)acrylates or mixtures thereof with vinylaromatics.

A butadiene-based copolymer is likewise preferred, i.e. the polymer comprises at least 60% by weight of butadiene or mixtures thereof with vinylaromatics.

In addition to the main monomers and the ethylenically unsaturated polymer, the polymer may contain other ethylenically unsaturated compounds, for example monomers comprising carboxyl, sulfo or phosphonic acid groups. Carboxyl groups are preferred. Examples are acrylic acid, methacrylic acid, itaconic acid, maleic acid or fumaric acid.

Hydroxyl-containing monomers, in particular $C_1$–$C_{10}$-hydroxyalkyl(meth)acrylates or (meth)acrylamide may also be mentioned.

Suitable other ethylenically unsaturated compounds are moreover phenoxyethylglycol mono(meth)acrylate, glycidyl acrylate, glycidyl methacrylate and amino (meth) acrylates, such as 2-aminoethyl(meth)acrylate.

The glass transition temperature of the polymer is preferably less than 50° C., in particular from −40 to +50° C., particularly preferably from −20 to +30° C., very particularly preferably from −10 to +25° C., especially from −5 to +20° C.

The glass transition temperature of the polymer can be determined by conventional methods, such as differential thermal analysis or differential scanning calorimetry (cf. for example ASTM 3418/82, midpoint temperature).

The copolymer is preferably prepared by emulsion polymerization and is therefore an emulsion copolymer.

However, the preparation can also be carried out, for example, by solution polymerization and subsequent dispersing in water.

In emulsion polymerization ionic and/or nonionic emulsifiers and/or protective colloids or stabilizeres are used as surfactant compounds.

A detailed description of suitable protective colloids appears in Houben-Weyl, Methoden der organischen Chemie, Volume XIV/1, Makromolekulare Stoffe, Georg-Thieme-Verlag, Stuttgart, 1961, pages 411 to 420. Suitable emulsifiers are anionic, cationic and nonionic emulsifiers. Preferably, exclusively emulsifiers whose molecular weight is usually less than 2000 g/mol, in contrast with the protective colloids, are preferably used as the accompanying surfactant substances. When mixtures of surfactant substances are used, the individual components must of course be compatible with one another, which, in case of doubt, can be checked by means of a few preliminary experiments. The surfactant substances used are preferably anionic and nonionic emulsifiers.

Conventional accompanying emulsifiers are, for example, ethoxylated fatty alcohols (degree of ethoxylation: from 3 to 50, alkyl radical: $C_8$ to $C_{36}$), ethoxylated mono-, di- and tri-alkylphenols (degree of ethoxylation: from 3 to 50, alkyl radical: $C_4$ to $C_9$), alkali metal salts of dialkyl esters of sulfosuccinic acid and alkali metal and ammonium salts of alkylsulfates (alkyl radical: $C_8$ to $C_{12}$), of ethoxylated alkanols (degree of ethoxylation: from 4 to 30, alkyl radical: $C_{12}$ to $C_{18}$), of ethoxylated alkylphenols (degree of ethoxylation: 3 to 50, alkyl radical: $C_4$ to $C_9$), of alkanesulfonic acids (alkyl radical: $C_{12}$ to $C_{18}$) and of alkylarylsulfonic acids (alkyl radical: $C_9$ to $C_{18}$).

Further suitable emulsifiers are compounds of the formula II (II)

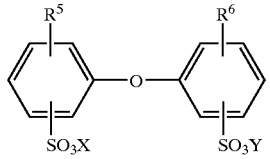

where $R^5$ and $R^6$ are each hydrogen or $C_4$–$C_{14}$-alkyl and are not simultaneously hydrogen, and C and Y may be alkali metal ions and/or ammonium ions. $R^5$ and $R^6$ are preferably each linear or branched alkyl of 6 to 18, in particular 6, 12 or 16, carbon atoms or hydrogen, $R^5$ and $R^6$ not both simultaneously being hydrogen. X and Y are preferably sodium, potassium or ammonium ions, sodium being particularly preferred. Particularly advantageous compounds II are those in which X and Y are each sodium, $R^5$ is branched alkyl of 12 carbon atoms and $R^6$ is hydrogen or $R^5$. Frequently, industrial mixtures which contain from 50 to 90% by weight of the monoalkylated product are used, for example Dowfax® 2A1 (trademark of Dow Chemical Company).

Suitable emulsifiers are also described in Houben-Weyl, Methoden der organischen Chemie, Volume 14/1, Makromolekulare Stoffe, Georg Thieme Verlag, Stuttgart, 1961, pages 192 to 208.

Tradenames of emulsifiers are, for example, Dowfax®2 A1, Emulan® NP 50, Dextrol® OC 50, Emulgator 825, Emulgator 825 S, Emulan® OG, Texapon® NSO, Nekanil® 904 S, Lumiten® I-RA, Lumiten E 3065, Disponil FES 77, Lutensol AT 18, Steinapol VSL, Emulphor NPS 25.

The surfactant substance is usually used in amounts of from 0.1 to 10% by weight, based on the monomers to be polymerized.

Water-soluble initiators for the emulsion polymerization are, for example, ammonium and alkali metal salts of peroxodisulfuric acid, e.g. sodium peroxodisulfate, hydrogen peroxide or organic peroxides, e.g. tert-butyl hydroperoxide.

Reduction-oxidation (redox) initiator systems are particularly suitable.

The redox initiator systems consist of at least one generally inorganic reducing agent and one inorganic or organic oxidizing agent.

The oxidation component is, for example, one of the abovementioned initiators for the emulsion polymerization.

The reduction components are, for example, alkali metal salts of sulfurous acid, e.g. sodium sulfite, of sodium hydrogen sulfite, alkali metal salts of disulfurous acid, such as sodium disulfite, bisulfite addition compounds of aliphatic aldehydes and ketones, such as acetone bisulfite, or reducing agents such as hydroxymethanesulfinic acid and salts thereof, or ascorbic acid. The redox initiator systems can be used in the presence of soluble metal compounds whose metallic component may occur in a plurality of valency states.

Conventional redox initiator systems are, for example, ascorbic acid/iron (II) sulfate/sodium peroxodisulfate, tert-butyl hydroperoxide/sodium disulfite, tert-butyl hydroperoxide/sodium hydroxymethanesulfinic acid. The individual components, for example the reduction component, may also be mixtures, for example a mixture of the sodium salt of hydroxymethanesulfinic acid and sodium disulfite.

Said compounds are generally used in the form of aqueous solutions, the lower concentration being determined by the amount of water acceptable in the dispersion and the upper concentration by the solubility of the relevant compound in water. In general, the concentration is from 0.1 to 30, preferably from 0.5 to 20, particularly preferably from 1.0 to 10, % by weight based on the solution.

The amount of the initiators is in general from 0.1 to 10, preferably from 0.5 to 5, % by weight, based on the monomers to be polymerized. A plurality of different initiators may also be used in the emulsion polymerization.

In the polymerization, it is possible to use regulators, for example in amounts of from 0 to 0.8 part by weight, based on 100 parts by weight of the monomers to be polymerized, by means of which the molar mass is reduced. For example compounds having a thiol group, such as tert-butylmercaptan, ethyl thioglycolate, mercaptoethanol, mercaptopropyltrimethoxysilane or tert-dodecyl mercaptan, are suitable.

The emulsion polymerization is carried out as a rule at from 30 to 130° C., preferably from 50 to 95° C. The polymerization medium can be either only of water or of a mixture of water and liquids miscible therewith, such as methanol. Preferably only water is used. The emulsion polymerization can be carried out both as a batch process and in the form of a feed process, including step or gradient procedure. Preference is given to the feed process, in which some of the polymerization batch is initially taken, is heated to the polymerization temperature and partly polymerized, and the remainder of the polymerization batch is then fed to the polymerization zone, usually via a plurality of spatially separated feeds, one or more of which contain the monomers in pure or in emulsified form, continuously, stepwise or with superposition of a concentration gradient while maintaining the polymerization. In the polymerization, a polymer may also be initially taken, for example for better adjustment of the particle size.

The manner in which the initiator is added to the polymerization vessel in the course of the free radical aqueous emulsion polymerization is known to the average person skilled in the art. It may either be initially taken in its entirety in the polymerization vessel or added continuously or stepwise at the rate at which it is consumed in the course of the free radical aqueous emulsion polymerization. Specifically, this depends on the chemical nature of the initiator system as well as on the polymerization temperature. Preferably, a part is initially taken and the remainder is fed to the polymerization zone at the rate of consumption.

To remove the residual monomers, initiator is usually added also after the end of the actual emulsion polymerization, i.e. after a monomer conversion of at least 95%.

In the feed process, the individual components can be added to the reactor from above, at the side or from below through the reactor base.

In the emulsion polymerization, aqueous dispersions of the polymer, as a rule having solids contents of from 15 to 75, preferably from 40 to 75% by weight, are obtained.

For a high space-time yield of the reactor, dispersions having a very high solids content are preferred. To be able to achieve solids contents >60% by weight, a bimodal or polymodal particle size should be established, since otherwise the viscosity becomes too high and the dispersion can no longer be handled. The creation of a new particle generation can be effected, for example by adding seed (EP 81083), by adding excess amounts of emulsifier or by adding miniemulsions. A further advantage associated with low viscosity in combination with high solids content is the improved coating behavior at high solids contents. The creation of a new particle generation or generations can be effected at any desired time. It depends on-the particle size distribution desired for a low viscosity.

The copolymer is preferably used in the form of its aqueous dispersion.

The novel paper coating slips contain the copolymer, as a binder, preferably in amounts of from 1 to 50, particularly from 5 to 20, % by weight, based on the pigment content of the paper coating slips (data based on the copolymer as such, i.e. solid, without solvent).

In addition to the binder, pigments are usually the main components of the paper coating slips. Frequently used pigments are, for example, barium sulfate, calcium carbonate, calcium sulfoaluminate, kaolin, talc, titanium dioxide, zinc oxide, chalk or coating clay or organic pigments, for example plastics in particulate form.

In addition to the binder and the pigments, the paper coating slips may contain further additives.

The paper coating slips may contain, for example, dispersants. Suitable dispersants are polyanions, for example of polyphosphoric acids or of polyacrylic acids (polysalts), which are usually present in amounts of from 0.1 to 3% by weight, based on the amount of pigment.

In addition, the paper coating slips may contain cobinders. Examples of natural cobinders are starch, casein, gelatin, alginates and soybean proteins, and examples of modified natural products are hydroxyethylcellulose, methylcellulose and carboxymethylcellulose and cationically modified starch. However, conventional synthetic cobinders, for example based on vinyl acetate or acrylate, may also be used.

These may be present, for example, in amounts of from 0.1 to 10% by weight, based on the amount of pigment.

For the preparation of the paper coating slip, the components are mixed in a known manner, the polymer generally being used in the form of an aqueous dispersion, suspension or solution.

The water content of the paper coating slip is usually brought to 25 to 75% by weight, based on the total paper coating slip (including water).

The paper coating slip may be applied by conventional methods to the papers to be coated (cf. Ullmann's Encyclopädie der Technischen Chemie, $4^{th}$ edition, Vol. 17, page. 603 et seq.).

The papers coated with the novel paper coating slips have high dry and wet pick resistance (adhesion of the paper coating slip). Consequently, they are particularly suitable for offset printing, in which the printing ink exerts high tensile forces on the coated paper.

The papers coated with the novel paper coating slips exhibit good printability. The papers are particularly suitable for offset printing processes.

EXAMPLES

I. Preparation of the Polymethacrylic Acid, Abbreviated to PMA (Ethylenically Unsaturated Polymer)

VA 044:

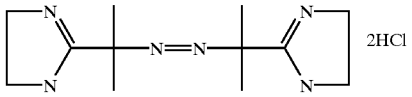

CoBF:

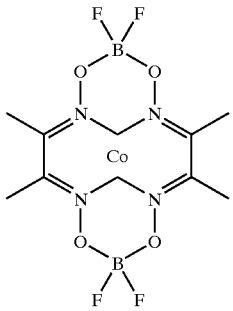

| | | |
|---|---|---|
| Initially taken mixture: | 17.5 mg | CoBF |
| | 0.75 g | VA 044 |
| | 450.00 g | demineralized water |
| Feed 1: | 190.00 g | methacrylic acid |
| | 9.00 mg | CoBF |

Procedure: Demineralized water was heated to the boil, and gaseous $N_2$ was passed in. Gaseous $N_2$ was also passed into feed 1. $N_2$ was forced through the apparatus and the latter was evacuated, this procedure being carried out 5 times. The initially taken mixture was sucked into the apparatus, it not being permitted for air simultaneously to be sucked in. The mixture was heated to 55° C., after which feed 1 was begun. The handling of the feed vessel corresponded to the initially taken mixture. Feed 1 was slowly added dropwise in 1.5 hours, further polymerization was effected for 1.5 hours and then cooling was carried out.

Analytical Data

| | Final sample |
|---|---|
| SC:* | 25.5% |
| Conversion: | 89% |
| pH: | 2.2 |
| GPC:** | |
| Mn: | 3,400 |
| Mw: | 7,200 |

SC:* Solids content,
**Standard: polyacrylic acid Eluent: $H_2O$

II. Preparation of the Polymer Dispersion

The initially taken mixture was heated to 85° C. and polymerized for 15 minutes. Thereafter, the monomer emulsion was metered in over 2 hours and the initiator (1% strength by weight solution of 6.29 g of sodium peroxodisulfate in $H_2O$) over 2.5 hours. Then further polymerization was effected for 1 hour and cooling was carried out.

Example 1 (for Comparison)

| | |
|---|---|
| Initially taken mixture: | 18 g of seed latex (polystyrene seed, 30 nm) |
| | 457 g of water |
| | 5% by weight of the monomer emulsion below |
| Monomer emulsion: | 330 g of n-butyl acrylate |
| | 270 g of styrene |
| | 24 g of acrylic acid |
| | 6.7 g of Dowfax 2 Al (45% strength in $H_2O$) |
| | 564 g of water |

Example 2

The preparation corresponded to Example 1, except that only 12 g of acrylic acid and additionally 12 g of PMA were used.

Example 3

The preparation corresponded to Example 1, except that only 6 g of acrylic acid and additionally 18 g of PMA were used.

Example 4

The preparation corresponded to Example 1, except that no acrylic acid was used and instead 24 g of PMA were employed. The composition of the copolymers in % by weight is stated in Table 1:

| Example | 1 | 2 | 3 | 4 |
|---|---|---|---|---|
| nBA | 52.9 | 52.9 | 52.9 | 52.9 |
| St | 43.3 | 43.3 | 43.3 | 43.3 |
| AA | 3.8 | 1.9 | 0.9 | — |
| PMA | — | 1.9 | 2.9 | 3.8 |

III. Preparation of Paper Coating Slip

A paper coating slip was prepared by stirring together the following components.

10 parts by weight of the copolymers 70 parts by weight of Hydrocarb (calcium carbonate)

30 parts by weight of Amazon (kaolin)

0.4 part by weight of polysalt (dispersant)

0.05 part by weight of NaOH 0.5 part by weight of CMC 7L2T (carboxymethylcellulose)

The solids content was 65% by weight with water.

Testing of Performance Characteristics

The base paper used was wood-free coating paper having a basis weight of 70 g/m$^2$. The paper coating slip was applied on one side in an amount of 10 g/m$^2$, on a laboratory coating apparatus. Drying was carried out using an IR lamp. Before testing of the performance characteristics, the paper passed four times through a laboratory calander (one pair of rollers, nip pressure: 2000 N/cm).

Dry Pick Resistance

Strips measuring 33×3 cm were cut in the longitudinal direction from the paper to be tested, and these strips were stored for 15 hours at 27° C. and a relative humidity of 50% in a conditioning chamber.

The strips were then printed in a printing unit (IGT printability tester AC2/AIC2) using a standard ink (printing ink 3808 from Lorilleux-Lefranc).

The test strips were passed through the printing unit at continuously increasing speed (maximum speed 200 cm/sec). The speed in cm/sec at which 10 tears from the paper coating slip (picks) occurred is stated as a measure of the dry pick resistance.

Wet Pick Resistance

The test-strips were produced and prepared as described above.

The printer used (IGT printability tester AC2/AIC2) was set up in such a way that the test strips were moistened with water before the printing process.

Printing was carried out at a constant speed of 0.6 cm/s.

Tears from the paper coating slip or the paper are visible as unprinted areas. To determine the wet pick resistance the ink density is therefore determined using an ink densitometer, in comparison with the solid tone, in %. The higher the stated ink density, the better is the wet pick resistance.

Offset Test

Paper:

Samples measuring 240×46 mm were cut in the longitudinal direction from the paper to be tested.

To Carry Out the Test:

An appropriate amount of printing ink was sent to the inking roll and the latter was allowed to run for 1 minute. Thereafter, a printing plate was inserted and inked for 30 seconds.

The printing speed was 1 m/s. A paper strip was brought back to the starting position on a printing sample support with the printed paper strip. After a specified period, the printing process was started again without changing the printing plate. This process was repeated several times.

After each pass, the picking of the printed side of the paper strip was visually assessed. The number of passes until picking occurred for the first time is stated. In the case of very pronounced picking, the last pass is stated only as half (e.g. strong picking after the 3$^{rd}$ pass is stated at 2.5).

Result:

Number of printing processes until occurrence of the first pick.

| Binder from | Dry pick resistance cm/s | Wet pick resistance | Offset test |
|---|---|---|---|
| Example 1 | 50 | 42.1 | 2.5 |
| Example 2 | 51 | 41.7 | 3 |
| Example 3 | 85 | 45.6 | 5 |
| Example 4 | 86 | 47.2 | 5 |

We claim:

1. A paper coated with a paper coating slip containing, as a binder, a copolymer which is prepared by free radical polymerization of ethylenically unsaturated compounds, wherein at least one of the ethylenically unsaturated compounds is a polymer having at least one copolymerizable ethylenically unsaturated group, a number average molecular weight ranging from 500 to 50000 g/mol and at least one carboxyl group.

2. The coated paper as claimed in claim 1, wherein the ethylenically unsaturated polymer contains one or two copolymerizable ethylenically unsaturated groups.

3. The coated paper as claimed in claim 1, wherein the ethylenically unsaturated group or groups of the ethylenically unsaturated polymer is or are an acryloyl or methacryloyl group.

4. The coated paper as claimed in claim 1, wherein the ethylenically unsaturated polymer contains more than 2 carboxylic acids.

5. The coated paper as claimed in claim 4, wherein the copolymer has a glass transition point of less than −40° to +50° C.

6. The coated paper as claimed in claim 1, wherein the ethylenically unsaturated polymer is synthesized from free radically polymerizable compounds.

7. The coated paper as claimed in claim 6, wherein the copolymer has a glass transition point of less than −20° to +30° C.

8. The coated paper as claimed in claim 1, wherein the ethylemcally unsaturated polymer is prepared by free radical polymerization in the presence of a transition metal complex as molecular weight regulator.

9. The coated paper as claimed in claim 1, wherein the copolymer is synthesized from:

a) from 30 to 99.9% by weight of at least one main monomer selected from the group consisting of $C_1$–$C_{20}$-alkyl (meth)acrylates, vinyl esters of carboxylic acids of up to 20 carbon atoms, vinylaromatics of up to 20 carbon atoms, ethylenically unsaturated nitriles, vinyl halides, vinyl ethers or allyl ethers of alcohols of 1 to 10 carbon atoms, aliphatic hydrocarbons having 2 to 8 carbon atoms and 1 or 2 double bonds or mixtures of these monomers, b) from 0.1 to 30% by weight of the ethylenically unsaturated polymer, and c) from 0 to 40% by weight of other ethylenically unsaturated compounds.

10. The coated paper as claimed in claim 9, wherein the copolymer is synthesized from:

a) from 50 to 99.9% by weight of said at least one main monomer, b) from 0.5 to 20% by weight of said ethylenically unsaturated polymer, and c) from 0 to 30% by weight of said other ethylenically unsaturated compounds.

11. The coated paper as claimed in claim 10, wherein the copolymer is synthesized from:

a) from 60 to 99.9% by weight of said at least one main monomer, b) from 1 to 20% by weight of said ethylenically unsaturated polymer, and c) from 0 to 20% by weight of said other ethylenically unsaturated compounds.

12. The coated paper as claimed in claim 1, wherein the copolymer has a glass transition point of less than 50° C.

13. A method of preparing a slip coated paper, comprising:

coating a paper substrate with a paper coating slip containing, as a binder, a copolymer which is prepared by free radical polymerization of ethylenically unsaturated compounds, wherein at least one of the ethylenically unsaturated compounds is a polymer having at least one copolynierizable ethylenically unsaturated group, a number average molecular weight ranging from 500 to 50000 g/mol and at least one carboxyl group.

* * * * *